US005868913A

United States Patent [19]

Hodgson

[11] Patent Number: 5,868,913

[45] Date of Patent: Feb. 9, 1999

[54] ELECTRODE AND PREPARATION THEREOF

[75] Inventor: David Ronald Hodgson, Merseyside, United Kingdom

[73] Assignee: Imperial Chemical Industries PLC, London, United Kingdom

[21] Appl. No.: 582,983

[22] PCT Filed: Aug. 4, 1994

[86] PCT No.: PCT/GB94/01718

§ 371 Date: Jan. 11, 1996

§ 102(e) Date: Jan. 11, 1996

[87] PCT Pub. No.: WO95/05499

PCT Pub. Date: Feb. 23, 1995

[30] Foreign Application Priority Data

Aug. 13, 1993 [GB] United Kingdom ..... 9316926

[51] Int. Cl.[6] ..... C23C 14/00

[52] U.S. Cl. ..... 204/298.01; 204/298.02; 204/298.04; 204/298.05; 204/298.41; 427/523; 427/528; 427/532; 427/533; 427/540; 427/546; 427/78; 427/124; 427/126.1; 427/126.2; 427/126.3; 427/126.5; 427/372.2; 427/383.1; 427/383.3

[58] Field of Search ..... 204/290 F, 284, 204/291, 298.01, 298.02, 298.04, 298.05, 298.41; 427/523, 528, 532, 533, 540, 546, 78, 124, 126.1, 126.2, 126.3, 126.5, 372.2, 383.1, 383.3

[56] References Cited

U.S. PATENT DOCUMENTS

| | | | |
|---|---|---|---|
| 4,696,731 | 9/1987 | Tenhover | 204/290 R |
| 4,724,169 | 2/1988 | Keem et al. | 204/192.16 |
| 5,334,293 | 8/1994 | Cairns et al. | 204/290 F |

FOREIGN PATENT DOCUMENTS

| | | |
|---|---|---|
| 0 099 866 | 2/1984 | European Pat. Off. . |
| 26 25 820 | 12/1976 | Japan . |

*Primary Examiner*—Bruce F. Bell

[57] ABSTRACT

Preparation of an electrode comprising a substrate of a valve metal or of an alloy thereof having similar properties thereto and a coating thereon comprising at least an outer layer of an electrocatalytically-active material which comprises an oxide of at least ruthenium and an oxide of at least one non-noble metal by a one-step coating process which comprises the vapor phase deposition of a mixture of at least ruthenium and/or oxide thereof and at least one non-noble metal or oxide thereof onto the substrate. The outer layer is of substantially uniform thickness, the contours thereof are at least substantially the same as the contours of the substrate underlying it and the electrode affords an increased surface area for a given mass of catalyst and a more efficient use of catalyst to obtain a given thickness thereof.

9 Claims, 1 Drawing Sheet

ELECTRODE AND PREPARATION THEREOF

FIELD OF THE INVENTION

This application is a 371 of PCT/GB94/01718 filed on Aug. 4, 1994.

This invention relates to an electrode for use in an electrolytic cell, particularly to an electrode for use as an anode in an electrolytic cell, especially in an electrolytic cell in which in operation chlorine is evolved at the anode, although use of the anode of the invention is not restricted to electrolyses in which chlorine is evolved, and to a method for the preparation of the electrode.

BACKGROUND OF THE INVENTION

Electrolytic processes are practiced on a large scale throughout the world. For example, there are many industrial processes in which water or an aqueous solution is electrolyzed, for example, an aqueous solution of an acid or an aqueous solution of an alkali metal chloride. Aqueous acidic solutions are electrolyzed in, for example, electrowinning, electrotinning and electrogalvanizing processes, and aqueous alkali metal chloride solutions are electrolyzed in the production of chlorine and alkali-metal hydroxide, alkali metal hypochlorite, and alkali metal chlorate. The production of chlorine and alkali metal hydroxide is practiced in electrolytic cells which comprise a mercury cathode or in electrolytic cells which comprise a plurality of alternating anodes and cathodes, which are generally of foraminate structure, arranged in separate anode and cathode compartments. These latter cells also comprise a separator, which may be a hydraulically permeable porous diaphragm or a substantially hydraulically impermeable ion-exchange membrane, positioned between adjacent anodes and cathodes thereby separating the anode compartments from the cathode compartments, and the cells are also equipped with means for feeding electrolyte to the anode compartments and if necessary liquid to the cathode compartments, and with means for removing the products of electrolysis from these compartments. In a cell equipped with a porous diaphragm, aqueous alkali metal chloride solution is charged to the anode compartments of the cell, and chlorine is discharged from the anode compartments and hydrogen and cell liquor containing alkali metal hydroxide are discharged from the cathode compartments of the cell. In a cell equipped with an ion-exchange membrane aqueous alkali metal chloride solution is charged to the anode compartments of the cell and water or dilute aqueous alkali metal hydroxide solution to the cathode compartments of the cell, and chlorine and depleted aqueous alkali metal chloride solution are discharged from the anode compartments of the cell and hydrogen and alkali metal hydroxide are discharged from the cathode compartments of the cell.

Electrolytic cells are also used in the electrolysis of non-aqueous electrolytes and in electrosynthesis.

It is desirable to operate such electrolytic cells at as low a voltage as possible in order to consume as little electrical power as possible and in such a way that the component parts of the electrolytic cell are long lasting, i.e. the electrodes in the electrolytic cell should have a long lifetime.

In recent years anodes which have been used in such electrolytic processes have comprised a substrate of titanium or of an alloy of titanium possessing properties similar to those of titanium and a coating of an electrocatalytically-active material on the surface of the substrate. An uncoated titanium anode could not be used in such an electrolytic process as the surface of the titanium would oxidize when anodically polarized and the titanium would soon cease to function as an anode. The use of such a coating of electrocatalytically-active material is essential in order that the titanium shall continue to function as an anode. Examples of such electrocatalytically-active materials which have been used include metals of the platinum group, oxides of metals of the platinum group, mixtures of one or more such metals and one or more such oxides, and mixtures or solid solutions of one or more oxides of a platinum group metal and tin oxide or one or more oxides of a valve metal, that is one or more oxides of titanium, tantalum, zirconium, niobium, hafnium or tungsten.

Recently it has been suggested in EP 0,437,178 that anodes wherein the coating comprises mixed oxides of iridium, ruthenium and titanium having oxide molar ratios of Ti:(Ir+Ru) of less than 1:1 and of Ru:Ir of between 1.5:1 and 3:1 can be prepared from a certain acidic aqueous solution.

Likewise, it has been suggested in J 59,064788 that electrode coatings can be prepared by the deposition of certain coatings from organic solvents onto a substrate followed by heating the coated substrate in oxygen.

SUMMARY OF THE INVENTION

We have now found surprisingly that electrodes for use in electrolytic cells may be prepared by the physical vapor deposition of a mixture of powders of (i) ruthenium oxide, (ii) a non-noble metal oxide, e.g. tin oxide, or a valve metal oxide and preferably (iii) a noble metal oxide other than ruthenium oxide (hereinafter referred to for convenience as "second noble metal oxide"), onto a suitable substrate. This method has the advantage that it affords a single step coating process for the preparation of an electrode. Moreover, the durability of the electrode may be improved by a subsequent heat treatment as is more filly described hereinafter.

The present invention provides a method for the preparation of an electrode which (a) comprises a substrate of a valve metal or alloy thereof and a coating on the substrate which comprises at least an outer layer having uniform thickness, particularly where prepared by RF sputtering, and of good electrocatalytic activity and (b) when used as an anode in a cell in which chlorine is evolved at an anode has an acceptable overvoltage and often, as is hereinafter more fully described, has high durability.

According to the present invention there is provided a method for the preparation of an electrode which comprises a substrate of a valve metal or of an alloy thereof and a coating thereon comprising at least an outer layer of an electrocatalytically-active material which comprises an intimate mixture of ruthenium oxide and at least one non-noble metal oxide which process comprises the step of depositing a mixture of the aforementioned oxides on the substrate by physical vapor deposition (PVD).

Preferably, mixture of oxides in the outer layer of the coating on the electrode prepared by the process according to the present invention contains an oxide of a second noble metal.

DETAILED DESCRIPTION

As examples of PVD may be mentioned inter alia radio frequency (RF) sputtering, sputter ion plating, arc evaporation, electron beam evaporation, dc magnetron, reactive PVD, etc. or combinations thereof. It will be appreciated that where combinations of evaporation techniques are used in the same evaporation chamber in the PVD system separate targets may be used, e.g. a ruthenium target and a tin target instead of, or in addition to, a mixed ruthenium/tin target. By "target" we mean the material which is vaporized to produce a vapor for deposition on the subtrate in the PVD system.

The substrate of the electrode comprises a valve metal or an alloy thereof Suitable valve metals include titanium, zirconium, niobium, tantalum and tungsten, and alloys comprising one or more such valve metals and having properties similar to those of the valve metals. Titanium is a preferred valve metal as it is readily available and relatively inexpensive when compared with the other valve metals.

The substrate may consist essentially of a valve metal or alloy thereof, or it may comprise a core of another metal, e.g. steel or copper, and an outer surface of a valve metal or alloy thereof.

The oxide of the non-noble metal in the outer layer of the coating may be, for example, a valve metal as hereinbefore described, or cobalt or preferably tin.

The oxide of the at least one second noble metal, where present in the outer layer of the coating, may be, for example, an oxide of one or more of rhodium, osmium, platinum or preferably iridium.

The electrode prepared by the process according to the present invention when used as an anode in an electrolytic cell in which chlorine is evolved at the anode, has a low overvoltage acceptable in terms of chlorine evolution, i.e. less than 100 mV at 3 kA/$m^2$. Moreover, we have found surprisingly that where the oxidic component of the aforementioned outer layer provides more than 30 atomic % of all the components in the outer coating, as measured by X-ray absorption spectroscopy, the electrode has high durability.

The possibility is not excluded of the coating of the electrode comprising one or more further layers intermediate the outer layer and the substrate, but it will be described hereinafter with reference to a coating which consists of only the aforementioned outer layer.

The layers in the coating are described as variously comprising an oxide of ruthenium and an oxide of at least one non-noble metal and preferably an oxide of at least one second noble metal. Although the various oxides in the layers may be present as oxides per se it is to be understood that the oxides may together form a solid solution in which the oxides are not present as such. For example, where a layer in the coating, particularly the outer layer, comprises a second noble metal oxide, e.g. iridium oxide, the intimate mixture may be in the form of a solid solution of, for example, ruthenium dioxide, iridium oxide and tin dioxide or a solid solution of two of them mixed with the third. We do not exclude the possibility that a noble metal per se or an alloy thereof may be present in the coating.

In general the electrode will be used in the electrolysis of aqueous electrolytes and although the electrode of the invention is particularly suitable for use as an anode at which chlorine is evolved the electrode is not restricted to such use. It may, for example, be used as an anode in the electrolysis of aqueous alkali metal chloride solution to produce alkali metal hypochlorite or alkali metal chlorate, or it may be used as an anode at which oxygen is evolved.

The over-voltage and useful working lifetime of the electrode prepared by the method according to the present invention is dependent at least to some extent on the ratio of the components in the coating on the electrode and on the thickness therof. The coating will generally comprise at least 10 mole % in total of oxide of noble metal, i.e. ruthenium and the second noble metal, where present, and at least 20 mole % of oxide of non-noble metal.

In general the coating will be present at a loading of at least 5 g/$m^2$ of nominal electrode surface, preferably at least 10 g/$m^2$. In general it will not be necessary for the coating to be present at a loading of greater than 100 g/$m^2$, preferably not greater than 50 g/$m^2$. Typically, the thickness of the outer layer of the coating is between 1 and 10$\mu$.

In the method according to the present invention, the chamber in the PVD system is charged with oxygen or ozone and an inert gas, preferably argon.

Where the method according to the present invention is carried out in the reactive mode, i.e. the target in the PVD system is metallic, the ratio of oxygen:argon is greater than 2:1 by volume and preferably is at least 4:1 by volume.

The specific conditions used in the method according to the present invention may be found by the skilled man by simple experiment.

For example, the pressure in the deposition chamber may be in the range $10^{-2}$ to $10^{-10}$ atmospheres, particularly where the coating comprises a mixture of ruthenium oxide, iridium oxide and tin oxide.

We have found that the useful working life of the electrode prepared by the method according to the present invention may be increased by subjecting it to a treatment at high temperature of at least 400° C., typically about 500° C., for at least one hour.

Where the electrode of the present invention comprises an intermediate layer it may, for example, comprise $RuO_2$ and an oxide of at least one non-noble metal. The oxide of the non-noble metal in the intermediate layer may be, for example, titanium oxide, zirconium oxide, or tantalum pentoxide or oxide of another valve metal. Alternatively, or in addition, the intermediate layer may comprise an oxide of a non-noble metal other than a valve metal, and tin is an example of such a non-noble metal.

The structure of the electrode, and of the electrolytic cell in which the electrode is used, will vary depending upon the nature of the electrolytic process which is to be effected using the electrode. For example, the nature and structure of the electrolytic cell and of the electrode will vary depending upon whether the electrolytic process is one in which oxygen is evolved at the electrode, e.g. as in an electrowinning process, an electroplating process, an electrogalvanising process or an electrotinning process, or one in which chlorine is evolved at the electrode, or one in which alkali metal chlorate or alklai metal hypochiorite is produced, as is the case where aqueous alkali metal chloride solution is electrolyzed. However, as the inventive feature of the present invention does not reside in the nature or structure of the electrolytic cell nor of the electrode there is no necessity for the cell or the electrode to be described in any detail. Suitable types and structures of electrolytic cell and of electrodes may be selected from the prior art depending on the nature of the electrolytic process. The electrode may for example, have a foraminate structure, as in a woven or unwoven mesh, or as in a mesh formed by slitting and expanding a sheet of valve metal or alloy thereof, although other electrode structures may be used.

Prior to deposition of the coating on the substrate the substrate may be subjected to treatments which are also known in the art. For example, the surface of the substrate may be roughened, for example by sand-blasting, in order to improve the adhesion of the subsequently applied coating and in order to increase the real surface area of the substrate. The surface of the substrate may also be cleaned and etched, for example by contacting the substrate with an acid, eg with an aqueous solution of oxalic acid or hydrochloric acid, and the acid-treated substrate may then be washed, e.g. with water, and dried.

According to the present invention there is provided an electrode which comprises a substrate of a valve metal or of an alloy thereof and a coating thereon comprising an outer layer of an electrocatalytically-active material which comprises an intimate mixture of ruthenium oxide and at least one non-noble metal oxide wherein the outer layer is of substantially uniform thickness and wherein the contours of the surface of the outer layer are at least substantially the same as the contours of the substrate immediately underlying it.

Such an electrode affords the advantages of an increased surface area for a given mass of catalyst and the more efficient use of the electrocatalytically-active material to obtain a minimum thickness thereof.

The contour of the surface of the outer layer of electrode coatings prepared by processes known in the art, for example by the method of Onuchukwa and Trasatti, J Applied Electrochemistry, 1991, Vol. 21,858, are non-uniform and tend to deviate from the contour of the surface of the substrate immediately underlying it, for example the outer layer is formed with thicker projections and shallower depressions.

We have found that where the outer layer of the coating of the electrode according to the present invention comprises a mixture of tin, iridium and ruthenium oxides it is often in the form of small particles, typically of less than 100A, of a iridium/ruthenium intermetallic, containing 70–100% of the iridium and 40–80% of the ruthenium, in a mixture of a poorly crystalline tin oxide/iridium oxide/ruthenium oxide mixture.

The present invention is illustrated by reference to the accompanying drawing which represents, by way of example only, a micrograph of an electrode according to the present invention prepared by the method of the present invention.

BRIEF DESCRIPTION OF THE DRAWING

In the drawing.

In FIG. 1, (1) is the electrode coating, (2) is the electrode substrate and (3) is the base on which the electrode was mounted for preparing the micrograph.

Figure 1:
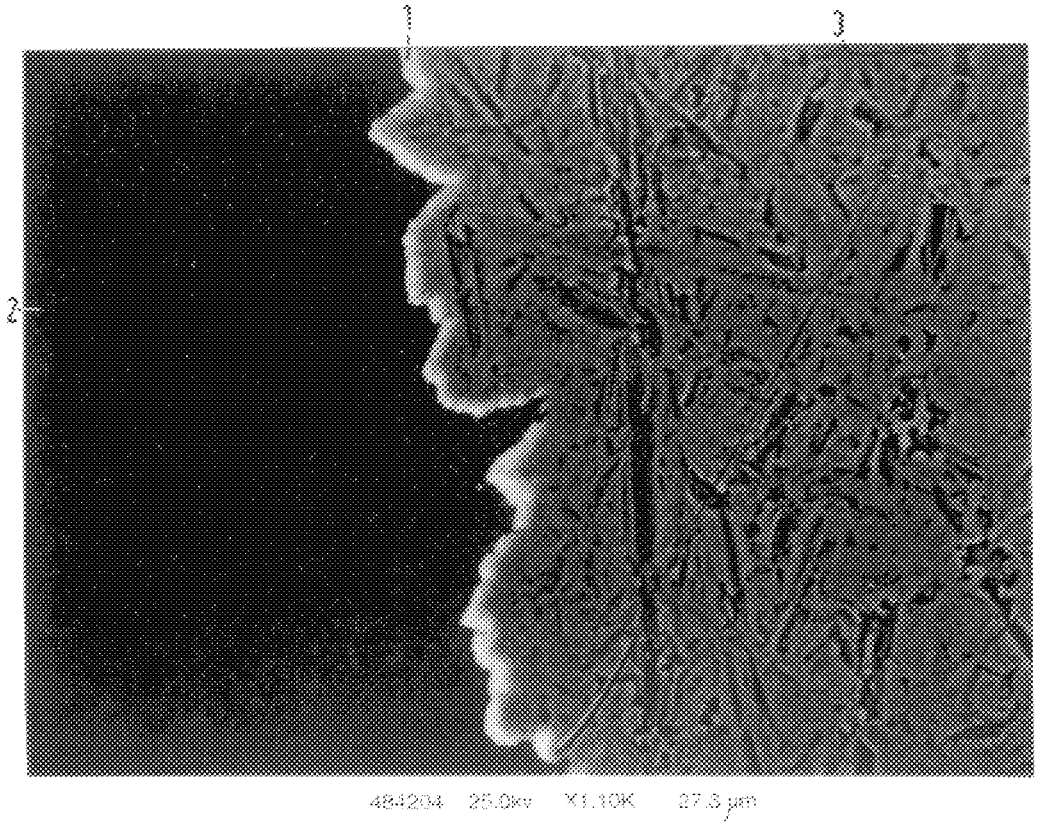
FIG. 1 is a micrograph of a cross-section of an electrode prepared in Example 1.

From FIG. 1, it can be seen that the electrode coating (1) is of uniform thickness and that the contour of the surface thereof is substantially the same as the contour of the substrate immediately underlying it (2).

The present invention is further illustrated by the following Examples.

EXAMPLES 1–2

These Examples illustrate the preparation of electrodes by the method according to the present invention using RF sputtering.

A powder for coating an electrode was prepared by dissolving $RuCl_3$ (7.5 g), $H_2IrCl_6$ (3.2 g) and $SnCl_2$ (13.5 g) in propan-2-ol (200 mls). The solution was evaporated to dryness under vacuum. Sodium nitrate (40 g) was added to the residual solid and the mixture was heated to 450° C. in air for 2 hours. The heat-treated mixture was washed with hot water then cold water and dried at 150° C. The dried solid was ground by glass beads and a portion of the ground solid was collected by sieving through +45, −106 standard meshes. In the collected portion, the weight ratio of Ru:Ir:Sn was 1.6:1:3.7.

Two samples of titanium sheet were cleaned by contacting them with acetone, the cleaned samples were dried, etched for 8 hours in 10% w/v oxalic acid at 90° C. and etched further immediately prior to coating.

The samples were separately mounted on stainless steel plates (held with a nickel foil mask) and disposed in the PVD system which was allowed to pump down overnight.

In Example 1, the pressure in the PVD system was adjusted to $6\times10^{-2}$ mbar by controlling the argon flow, the powder target was presputtered for 5 hours at 500 W incident RF power, the target shutter was removed and the sample was coated for 20 hours. A nominal coating thickness of 2 $\mu$m was obtained.

In Example 2, the pressure in the PVD system was adjusted to $5\times10^{-1}$ mbar by controlling the argon flow, the already conditioned powder target from Example 1 was presputtered for 2 hours at 500 W incident RF power, the target shutter was removed and the sample was coated for 20 hours. A nominal coating thickness of 2 $\mu$m was obtained.

The coated titanium samples from Examples 1 and 2 were separately installed in electrolytic cells as an anode and spaced from a nickel cathode. The anode was subjected to an accelerated test in which an aqueous solution containing 20 weight % NaCl and 20 weight % NaOH was electrolyzed at a constant current density of 20 kA/m$^2$ and at a temperature of 65° C.

The electrode was tested for chlorine-producing activity, i.e. chlorine overpotential, by measurement of the potential decay curve as a constant current is interrupted.

In a Comparative Test, an anode comprising a coating of $RuO_2$:$IrO_2$:$SnO_2$ in weight ratio 25:10:65 was prepared by so-called spray-baking. The spray-baked anode was prepared by: (i) rolling a bottle containing $RuCl_3$ (1.5 g) in pentanol (30 cm$^3$) for 8 hours, adding $H_2IrCl_6$ (0.63 g) to the solution formed thereby and rolling for 2 hours; (ii) adding stannous octoate (6.2 g), 4-tert-butyl catechol (0.15 g) and 2,5-di-tert-butyl quinol (0.15 g) to the solution formed in (i) and rolling for 1 hour; (iii) coating a titanium substrate by applying a portion of the solution from (ii) thereto by brush; (iv) drying the coated substrate by heating for 10 minutes at 180° C. and (v) baking the dried coated substrate at 510C. for 20 minutes. Steps (iii)–(v) were repeated until a coating on the titanium substrate of the desired thickness was obtained.

Samples from Examples 1 and 2 were post heat-treated at 500° C. for 2 hours in flowing air. The useful working lives of the post heat-treated samples and of the anode from the Comparative Test were determined.

The useful working life-time of the electrode is defined as the time taken for the anode to cathode voltage in the aforementioned solution to rise 2 V above its starting value. The results are shown in Table 1 from which it can be seen that anodes prepared by the method according to the present invention have good activity and good durability.

TABLE 1

| Example | Chlorine overpotential at 3 kAm$^{-2}$ (mV) | Working life-time of heat-treated anode (hours) |
|---|---|---|
| 1 | 85 | >360 |
| 2 | 55 | >380 |
| CT | 60 | 264 |

CT: Comparative Test

EXAMPLE 3

This Example illustrates the good long term performance of an electrode prepared by the method according to the present invention in the production of chlorine.

The procedure of Example 1 was repeated and the heat-treated electrode was installed as an anode in a laboratory membrane cell containing a Nafion (RTM) 90209 membrane, nickel cathode, anolyte of saturated brine at 90° C. and catholyte of 32% sodium hydroxide at 90° C. The cell was operated at 3 $kAm^{-2}$.

Cell voltage data obtained therefrom is shown in Table 2 from which it can be seen that the electrode has a good long-term performance.

TABLE 2

| Time on load (days) | Cell voltage (volts) |
|---|---|
| 0 | 3.3 |
| 127 | 3.4 |

Measurements of $RuO_2$ content of the electrocataixtically-active coating by X-Ray fluoresence (XRF) analysis revealed low coating losses under the aforementioned operating conditions as shown in Table 3.

TABLE 3

| Time on load (days) | Loading $RuO_2$ ($g/m^2$) |
|---|---|
| 0 | 10.63 |
| 373 | 10.14 |

EXAMPLES 4–5

These Examples illustrate electrodes prepared by the method according to the present invention using arc-evaporation.

Ruthenium and tin metal powders, in weight ratio 3:7, were mixed and hot-pressed to form a PVD target. The PVD target was disposed in an arc evaporation system and a mixture of oxygen and argon was passed through the system.

Material was evaporated from the target and deposited onto titanium substrates which had been etched by the procedure described in Example 1.

The conditions used in the arc evaporation system are shown in Table 4.

TABLE 4

| | Arc Current | Flow Rates (sccm) | | Substrate | Chamber Pressure |
|---|---|---|---|---|---|
| Example | (A) | $O_2$ | Ar | Bias (Volts) | (mbar) |
| 4 | 35 | 80 | 10 | −50 | 0.003 |
| 5 | 20 | 40 | 10 | −50 | 0.003 |

The chlorine overpotential of the electrode of Example 4 was found to be 85 mV at 3 $kAm^{-2}$, measured by the so-called "current interrupt method" in which a constant current was interrupted, the potential decay curve was displayed on an oscilloscope from which the overpotential could be read directly.

I claim:

1. A method for the preparation of an electrode comprising a substrate of a valve metal or of an alloy thereof and a coating comprising at least an outer layer of an electrocatalytically-active material which comprises an intimate mixture of ruthenium oxide and at least one non-noble metal oxide which method comprises the Steps of:

(A) deposition a mixture comprising said oxides onto the substrate by physical vapor depositing (PVD) in the deposition chamber in a PVD system charged with oxygen or zone and an inert gas with the provision that where the reaction is carried out in the reactive mode, the ratio of oxygen or zone to argon is greater than 2:1 by volume; and (B) subjecting the coated substrate prepared in step (A) to heat treatment at a temperature of at least 400° C. for at least 1 hour.

2. A method as claimed in claim 1 wherein the physical vapor deposition comprises radio frequency sputtering, sputter ion plating, arc evaporation, electron beam evaporation, dc magnetron evaporation, or reactive physical vapor deposition.

3. A method as claimed in claim 1 wherein the pressure in the deposition chamber in the PVD system is in the range of from $10^{-2}$ to $10^{-2}$ atmospheres.

4. A method as claimed in claim 1 wherein the non-noble metal is tin.

5. A method as claimed in claim 1 wherein the intimate mixture comprises ruthenium oxide, a non-noble metal oxide and an oxide of a second noble metal.

6. A method as claimed in claim 5 wherein the second noble metal is iridium.

7. A method as claimed in claim 6 wherein the coating comprises a mixture of RuO2, IrO2 and SnO2.

8. A method as claimed in claim 1 or 5 wherein the coating comprises at least 10 mole % of oxide of noble metal and at least 20 mole % of oxide of non-noble metal.

9. A method as claimed in claim 1 wherein the heat treatment in Step (B) is carried out at about 500° C.

* * * * *

UNITED STATES PATENT AND TRADEMARK OFFICE

CERTIFICATE OF CORRECTION

PATENT NO. : 5,868,913

DATED : February 9, 1999

INVENTOR(S) : David R. Hodgson

It is certified that error appears in the above-identified patent and that said Letters Patent is hereby corrected as shown below:

Claim 1 at (A), line 1, "deposition" should be --depositing--.

Claim 1, at (A), line 2, "depositing" should be --deposition--.

Claim 1 at (A), lines 4 and 7, "zone" should be --ozone--.

Claim 3, line 3, the second "$10^{-2}$" should be --$10^{-10}$--.

Signed and Sealed this

Twenty-eighth Day of March, 2000

*Attest:*

*Attesting Officer*

Q. TODD DICKINSON

*Commissioner of Patents and Trademarks*